US005215254A

United States Patent [19]

Haruch

[11] Patent Number: 5,215,254

[45] Date of Patent: Jun. 1, 1993

[54] SELF CLEANING SPRING-LOADED NOZZLE

[75] Inventor: James Haruch, Naperville, Ill.

[73] Assignee: Spraying Systems Co., Wheaton, Ill.

[21] Appl. No.: 919,142

[22] Filed: Jul. 23, 1992

[51] Int. Cl.[5] ..... B05B 15/02

[52] U.S. Cl. ..... 239/107; 239/453; 239/456

[58] Field of Search ..... 239/106–109, 239/451–454, 456, 459

[56] References Cited

U.S. PATENT DOCUMENTS

| | | | |
|---|---|---|---|
| 1,152,225 | 8/1915 | Ryan | 239/453 |
| 1,505,331 | 8/1924 | Gold | 239/107 |
| 1,628,823 | 5/1927 | Chester et al. | 239/453 |
| 2,612,408 | 9/1952 | Kurata | 239/453 |
| 2,768,860 | 10/1956 | Miller | 239/453 |
| 2,770,498 | 11/1956 | Filliung et al. | 239/452 |
| 2,803,499 | 8/1957 | Goyette et al. | 239/452 |
| 2,954,170 | 9/1960 | Goyette et al. | 239/109 |
| 3,165,383 | 1/1965 | Murray et al. | 239/108 |
| 3,267,959 | 8/1966 | Savage | 239/453 |
| 3,662,781 | 5/1972 | Figliola et al. | 239/453 |
| 3,719,327 | 3/1973 | McMahan | 239/454 |
| 3,990,637 | 11/1976 | Nicholson | 239/108 |
| 4,079,762 | 3/1978 | Hanson, Jr. | 239/453 |
| 4,190,204 | 2/1980 | Nicholson | 239/109 |
| 4,269,355 | 5/1981 | Geberth, Jr. | 239/107 |
| 4,585,173 | 4/1986 | Soule | 239/459 |
| 5,024,385 | 6/1991 | Olson et al. | 239/453 |
| 5,033,676 | 7/1991 | King et al. | 239/107 |

*Primary Examiner*—Andres Kashnikow
*Assistant Examiner*—Karen B. Merritt
*Attorney, Agent, or Firm*—Leydig, Voit & Mayer

[57] ABSTRACT

A self-cleaning spray nozzle in which a standard fitting serves as the nozzle body. A unitary valve assembly is inserted partially into the fitting and secured to it. The valve assembly includes a secured valve seat biased by a spring into a spraying head so that the valve seat and spraying head form a seal. The spraying head is designed so that it does not form a complete seal with the valve seat, the gap in the seal defining a metering orifice so that under normal fluid pressures, fluid will spray out of the orifice in a predetermined pattern. When a force sufficient to overcome the spring bias is applied to the spraying head, the spraying head separates from the valve seat breaking the seal and allowing the fluid to flush the outlet. The force can either be applied manually, or caused by an increase in fluid pressure. An optional deflection collar may be snapped onto the nozzle for influencing the direction of the spray.

16 Claims, 3 Drawing Sheets

FIG. 1
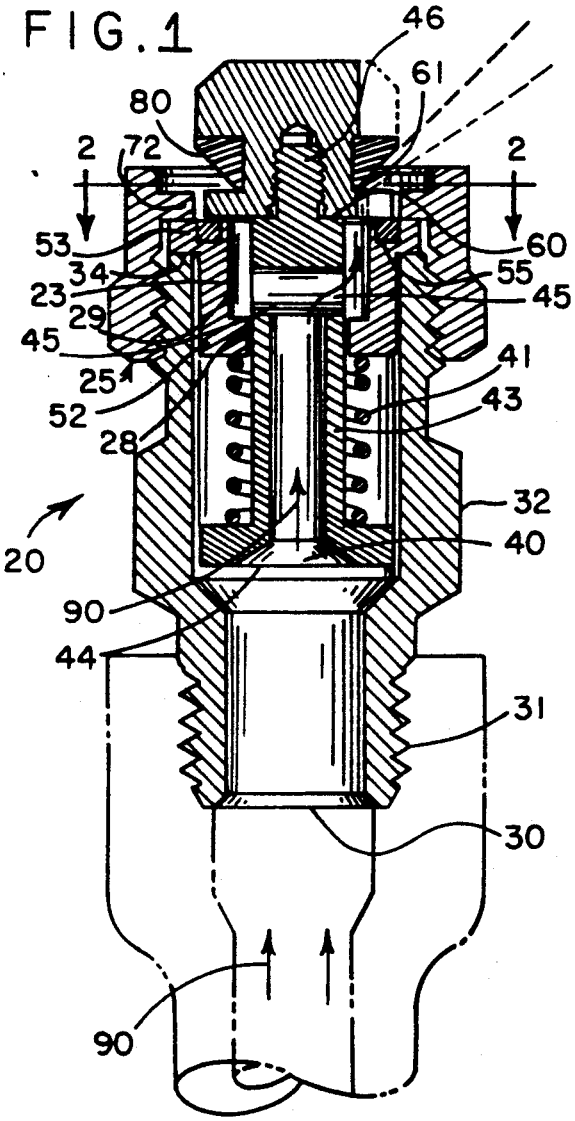
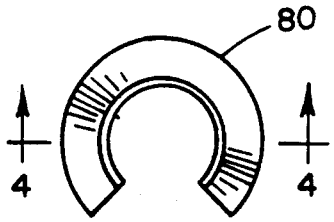
FIG. 3
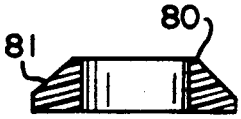
FIG. 4
FIG. 5
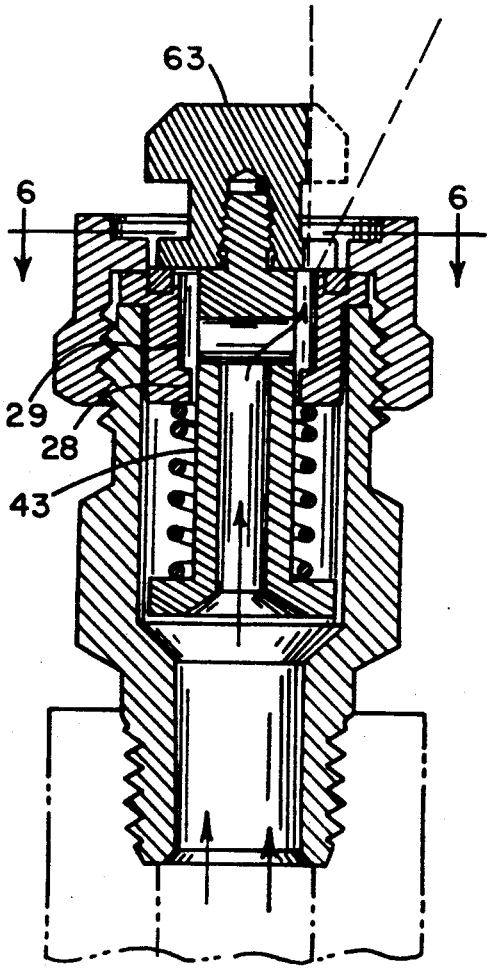
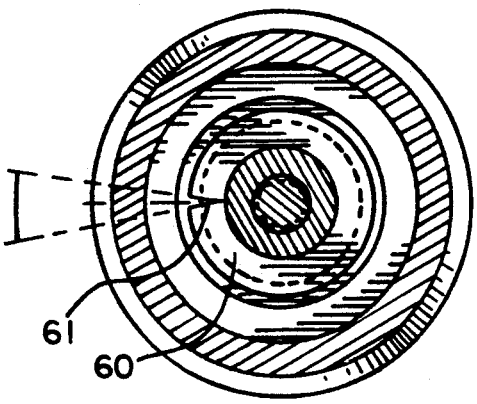
FIG. 2

SELF CLEANING SPRING-LOADED NOZZLE

FIELD OF THE INVENTION

The present invention relates generally to spray nozzles, and more particularly to a self-cleaning spray nozzle for low pressure spraying of lubricating solutions.

BACKGROUND OF THE INVENTION

Spray nozzles are used for many various purposes, including industrial spraying operations. Certain industrial spraying applications, in particular the lubrication of conveyor belts, require that a lubricant, typically soap based, be sprayed at low flow rates such as one-to-five gallons per hour. Applications utilizing these spraying nozzles often demand relatively narrow spray angles, and as a result, small metering orifices are required. However, the use of small orifices when combined with low flow rates often leads to clogging problems, especially when dealing with lubricating solutions in which particulate matter is present in the lubricant. Accordingly, particulate materials often build up and clog the nozzle, and it is often necessary to clean the nozzle to resume proper spraying operation.

Some nozzles are designed to facilitate manual cleaning. For example, one such nozzle discloses a valve designed to be lifted with a screwdriver for cleaning. While at times desirable, in certain applications, such as with a large number of spraying nozzles, manual valve cleaning is time consuming and can be dangerous.

Another way to dislodge particulate matter accumulated in the nozzle is to have a self-cleaning nozzle, whereby an increase in the fluid pressure causes a poppet valve to lift itself and attached sealing means away from a special housing containing the metering orifice. This results in a change in the outlet dimension of the metering orifice so that particles clogging the nozzle can become dislodged by the fluid flow.

U.S. Pat. No. 5,033,676 demonstrates one such nozzle. This nozzle comprises a dual mode poppet valve with a head carrying a seal designed to rest against the surface of a housing. In the flushing mode, the head and seal lift to create an unrestricted orifice under a high fluid pressure. Under a lower pressure, the seal rests against a surface in the housing in order to form a restricted orifice.

With this design, however, a special housing must be custom machined, since the restricted orifice is defined by where the seal of the poppet head seats on the surface of the housing. As a result, in order to provide a controlled spray, the housing must be designed to provide a surface that properly mates with the seal as well as being carefully notched in its interior surface to provide a metering orifice.

Since a notch cut into the interior of the housing at the seal is responsible for the spraying pattern, the entire housing must be replaced in order to change the pattern. Thus, with such a design, the spraying pattern cannot be easily and inexpensively modified.

Additionally, means must be machined into the fitting allowing the head and attached valve stem to slide upward but not out of the housing. Finally, the exterior of the housing must somewhat resemble a hose fitting so that hoses feeding the fluid source to the fitting can be easily attached. Such a housing is both expensive and difficult to manufacture, and is dedicated to a single nozzle design.

OBJECTS AND SUMMARY OF THE INVENTION

Accordingly, it is an object of the present invention to provide a self-cleaning spray nozzle having a valve assembly that can be easily inserted into an unmodified standard fitting.

It is also an object of the present invention to provide a self-cleaning spray nozzle having a valve assembly designed for insertion into an unmodified standard fitting that can dislodge accumulated particulate material with the application of an external force.

It is another object of the present invention to provide a self-cleaning spray nozzle that can dislodge accumulated particulate material with a controlled increase in fluid pressure.

It is a further object of the present invention to provide a self-cleaning spray nozzle that dislodges accumulated particulate material with a simple manual procedure.

It is another object of the invention to provide a self-cleaning spray nozzle wherein multiple spraying patterns can be obtained from a simple interchange of parts.

It is another object of the invention to provide a self-cleaning spray nozzle that is aimable with a simple hand adjustment.

It is another object of the invention to provide a self-cleaning spray nozzle that cannot have its flushing pressure sensitivity easily changed.

Other objects and advantages will become apparent from the following detailed description when taken in conjunction with the drawings, in which:

BRIEF DESCRIPTION OF THE DRAWINGS

FIG. 1 is an enlarged, longitudinal view in vertical section of the spray nozzle illustrating the fluid flow through the nozzle when in its spraying position, including an optional deflection collar according to one embodiment of the invention;

FIG. 2 is an elevational view of the spray nozzle taken in the plane of the line 2—2 in FIG. 1;

FIG. 3 is an enlarged elevational view of the optional deflector collar in accordance with one embodiment of the invention;

FIG. 4 is a side view of the optional deflector collar taken in the plane of the line 4—4 in FIG. 3;

FIG. 5 is an enlarged, longitudinal view in vertical section of the spray nozzle illustrating the fluid flow through the nozzle when in its spraying position without the optional deflection collar, according to one embodiment of the invention;

DETAILED DESCRIPTION OF THE PREFERRED EMBODIMENTS

Figures 6, 7, 8:
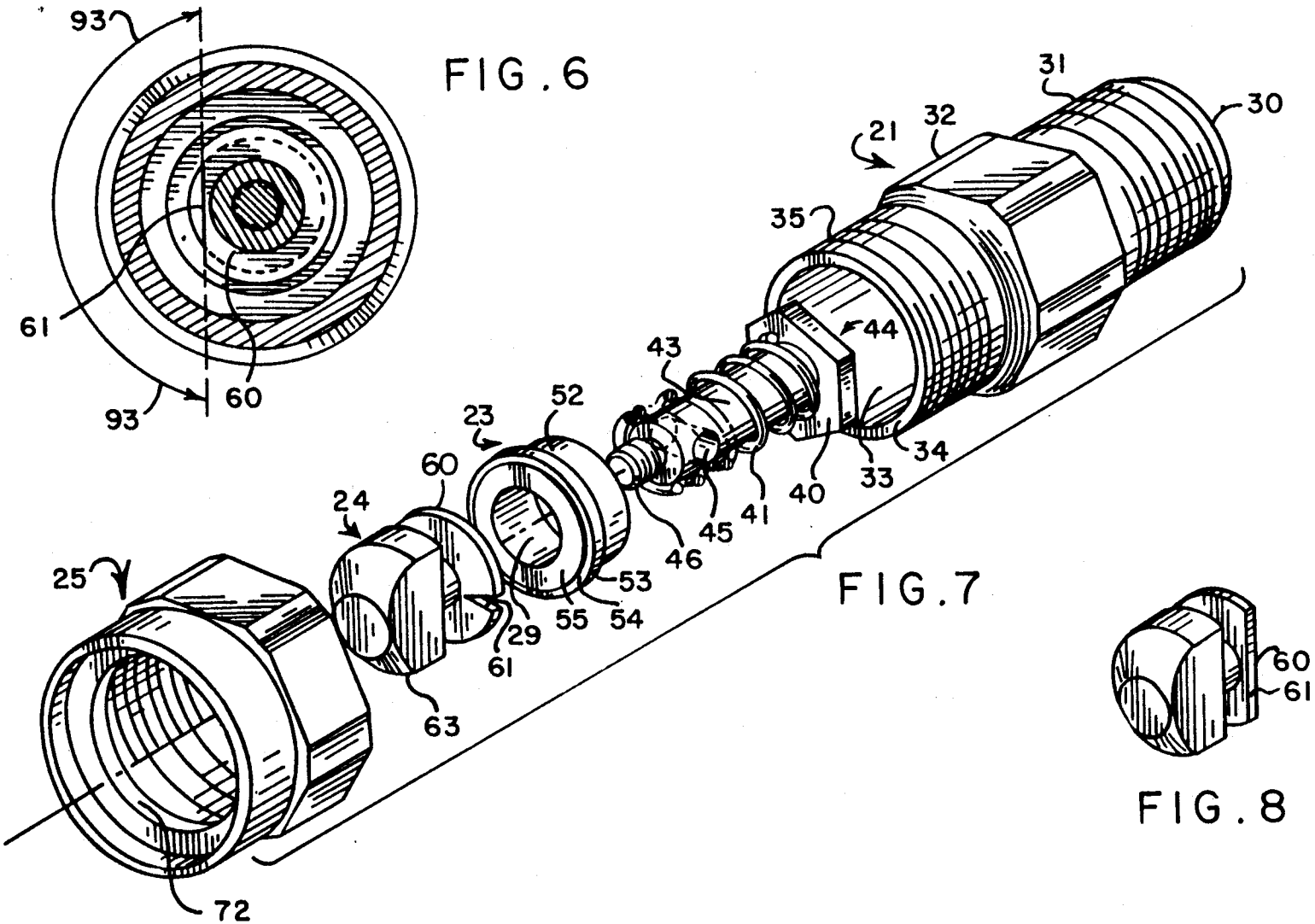
FIG. 6 is an elevational view of the spray nozzle taken in the plane of the line 6—6 in FIG. 5.
FIG. 7 is an enlarged, exploded view of the elements of the spray nozzle other than the deflection collar.
FIG. 8 is an enlarged view of an alternative spraying head that can be utilized in place of the spraying head illustrated in FIG. 7.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

Referring to FIG. 1 of the drawings, there is shown an illustrative spray nozzle assembly 20. The nozzle 20 connects to a pressurized fluid source, such as by screw threads 31, whereby fluid flows generally in the direction of the longitudinal axis of the nozzle. The arrows 90 illustrate the general flow of the fluid, i.e., through an inlet 30, a stem 43, and out of outlet means 61. Although illustrated as flowing vertically, it is understood that the nozzle oan be oriented in any direction without departing from the spirit and scope of the present invention.

As illustrated in FIG. 1, valve seat 23 is biased by spring 41 against a mating surface 60 of a spraying head at washer 55, creating a seal between the mating surface 60 and the valve seat 23. In order for fluid to escape the seal, outlet means 61 is present in the mating surface 60. FIG. 2 more clearly shows the outlet means 61 of one embodiment of the invention. As shown in FIG. 2 a notch is present in mating surface 60, resulting in an opening in the seal at the notched location. The notch creates a metering orifice that allows fluid to be sprayed in a predetermined spraying pattern.

In order to direct the spray away from the longitudinal axis of the nozzle, an optional deflection collar 80 may be added as shown in FIG. 1. As shown in FIGS. 3 and 4, the deflection collar 80 is designed to be snapped on and off of the nozzle just downstream of the notched mating surface 60 of FIG. 1. Accordingly, the deflection collar 80 must be made of a somewhat flexible material, preferably plastic. As shown in FIG. 4, the angle of spray pattern can be altered by adjusting the angle of the deflection surface 81 on the deflection collar 80.

Thus, as shown in FIG. 5, without the deflection collar some of the fluid will be sprayed parallel to the longitudinal axis of the nozzle. As a result, a portion of the upper part 63 of the spray head is shown as having been removed so as not to interfere with the sprayed fluid. Moreover, by having the upper portion 63 of the spray head be less than completely circular, an additional feature is that the spraying head is easier to grip.

As shown in FIG. 6 an even wider spray angle is obtainable using the spraying head of FIG. 8. Instead of the small, wedge shaped notch of FIG. 2 being utilized to establish the metering orifice, a much wider angle is present which is shown by arrows 93 in FIG. 6 to be approximately 180 degrees.

As illustrated in FIG. 7, the exterior housing of the spray nozzle is mainly comprised of a fitting 21, which may be a standard Unijet TM or a Teejet TM fitting available from Spraying Systems, Inc. of Wheaton, Ill. The fitting 21 is essentially tubular and defines a longitudinal fluid passage from inlet 30 to outlet 33. As FIG. 7 further shows, fluid inlet 30 has screw threads 31 for connecting to a fluid source via means such as a hose (not shown). Although this is one way for fluid to reach the fitting 21, other connection means such as complementary push-on connectors are also feasible. Additionally, the fitting typically has a central portion 32 as illustrated, which is adapted to receive a wrench for tightening the fitting 21 as needed.

Tubular stem 43 is secured to flange 40 and dimensioned to fit into the outlet 33 of the fitting 21. As best shown in FIG. 1, the upstream side of the flange 40 may be funnel shaped to facilitate fluid flow into the stem 43. Tubular stem 43 is essentially hollow and provides a fluid passage from inlet 44 to outlet 45. In the preferred embodiment, outlet 45 is a hollow opening drilled through the stem at an angle perpendicular to the axis of the stem. The hollow outlet opening is joined with the axial hollow inlet opening so that fluid entering the inlet 44 of the stem 43 flows through the stem and out of the outlet 45. While the outlet opening 45 in the preferred embodiment is perpendicular to the stem axis, other configurations of the opening are also conceivable, such as an angled outlet.

A valve seat 23 including a skirt 52 and a lip 53 is dimensioned to slidably fit over the stem 43. A coil spring 41, biased against the flange 40 of the stem, biases the valve seat 23 away from the flange 40. Spraying head 24 is adapted to connect to the stem, by way of connecting means 46 which extends from one end of the stem 43. The connection means 46 is preferably a threaded shaft integral to the stem 43. When connected to the stem 43, the mating surface 60 of the spraying head 24 presses against the downstream surface 54 of the valve seat 23, since valve seat 23 is forced into the spraying head by the spring 41. If desired, a washer 55, such as a teflon washer, can be added to help seal the mating area. Preferably, the washer 55 is glued or otherwise securely attached to the valve seat 23 so that it remains in place when the spraying head 24 is disengaged from the valve seat 23.

The stem 43, spring 41, valve seat 23 and spraying head 24 are all connected into a unitary valve assembly that is inserted into the fitting 21. This unitary construction allows a standard, unmodified fitting such as the fitting 21 to serve as the exterior body for the spray nozzle. Thus, the manufacturing costs are significantly lower with such a construction. Moreover, to change spraying characteristics, or in the event of a failure, a new valve assembly can quickly and easily be inserted into the standard fitting, thus reducing maintenance costs.

The valve seat 23 is dimensioned so that the skirt 52 can be inserted into the outlet 33 of fitting 21, with the lip 53 of the valve seat 23 set against the rim 34 of the fitting. In the preferred embodiment, the lip 53 has substantially the same circumference as the rim 34.

To secure the components in the valve assembly to the fitting 21, means for maintaining the valve seat 23 in positive contact with the fitting are provided. In the preferred embodiment, a cap 25 is used as the means for maintaining contact, and is adapted to connect to threads 35 of the fitting 21 at the outlet end 33 These threads may be further sealed to limit leakage, for example with teflon tape, although this is not ordinarily necessary.

The cap 25 fits over the spraying head 24 but not the lip 53 of the valve seat 23. As a result, the valve seat 23 is secured to the fitting 21, but the spraying head 24 and connected stem 43 remain capable of longitudinal movement. However, the ease of longitudinal movement is controlled by the force of the spring 41, and the amount of longitudinal movement is limited by the maximum compression of the spring 41 and the flange 40 of the stem 43.

Figure 9:
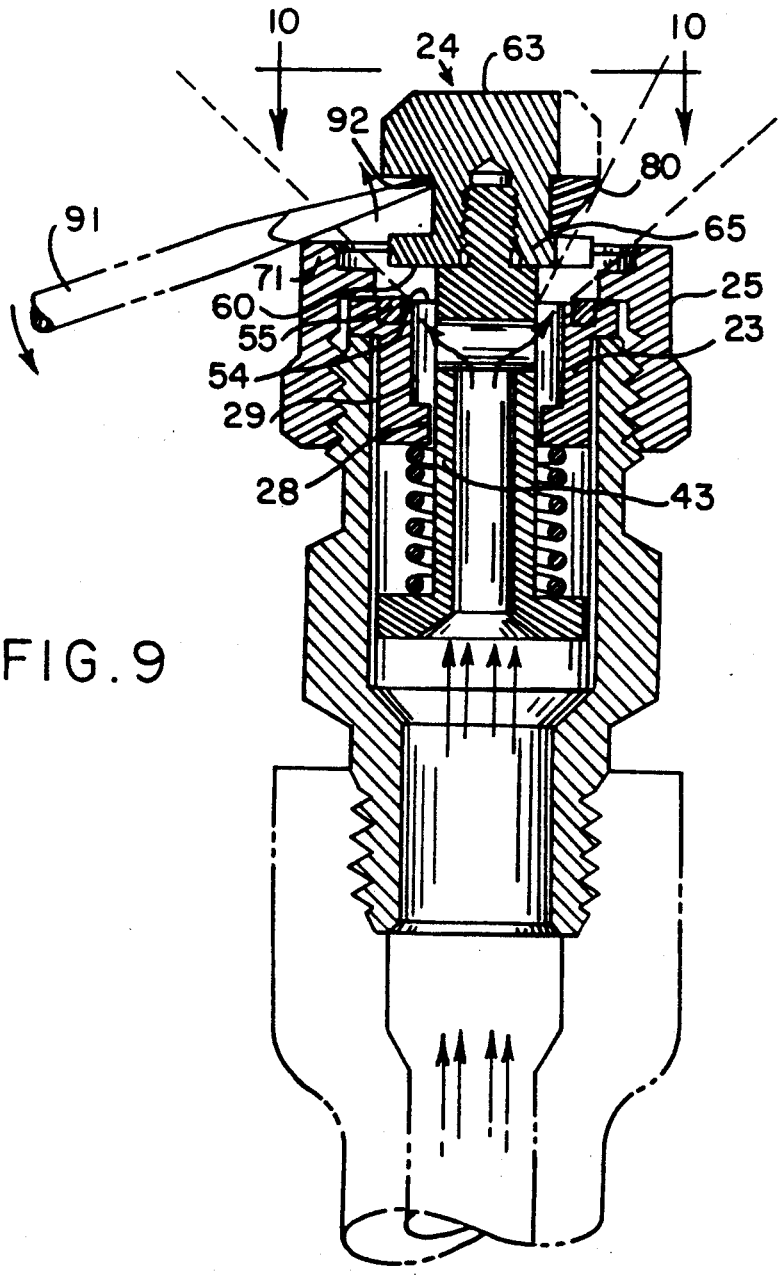
FIG. 9 is an enlarged, longitudinal view in vertical section of the spray nozzle illustrating the fluid flow through the nozzle when forced into its separated flushing position.

The amount of radial movement of the spraying head 24 and secured stem 43 relative to the valve seat 23 depends on the tolerance between the innermost dimension of the skirt 52 and the stem diameter, since the skirt 52 slidably fits over the stem 43. Thus, to keep the spraying head 24 reasonably sturdy in the radial direction, a reasonably tight tolerance must be chosen, although not so tight as to prevent the valve seat 23 from freely sliding on the stem 43. However, in order for fluid to freely flow out of outlet opening 45 and not be restricted by the inner diameter of the skirt 52, the skirt 52 has two coaxial inner diameters. As best shown in FIGS. 1, 5 and 9, a first inner diameter 28 at the upstream end of the valve seat 23 limits the radial movement of the valve seat 23 relative to the stem 43, while a second, larger inner diameter 29 allows fluid to freely exit the outlet opening 45 on the stem 43. In the preferred embodiment, the position of the outlet opening 45 is located so that even at maximum spring extension, the position of the outlet opening coincides with the longitudinal position of the larger inner diameter 29.

Although the valve seat 23 cannot move axially or radially, the valve seat 23 and thus the entire valve assembly can be rotated. In the preferred embodiment, this is accomplished by a smooth ring portion 72 of cap 25, which secures the lip 53 of the valve seat 23 to the rim 34 of the fitting 21. As long as the rotational friction creates less resistance than required to unscrew the spraying head 24 from the valve stem 43, the valve assembly can be rotated by simply turning the spraying head. As a result, the stream can be easily redirected.

In order for fluid to escape the nozzle, and to do so in a predetermined pattern, the mating surface 60 of the spraying head 24 is provided with an outlet means 61. The outlet means may be a small angle notch cut from the surface 60, as shown in FIG. 7, or a larger section as shown in FIG. 8. In general, the size of the area removed determines the width of the spraying angle, the narrower the angle, the narrower the spray. Other spraying patterns can be obtained merely by altering the shape, size and/or position of the outlet means in the mating surface 60.

FIG. 9 shows the mating surface 60 of the spraying head being separated from the valve seat 23 with a leveraging force. As a result, a much larger orifice is obtained, thus flushing the nozzle with the fluid flow. Any accumulated particulate matter trapped at the normal metering orifice has a larger escape area when the spraying head 24 is separated from the valve seat.

Although FIG. 9 illustrates one method of separating the spraying head from the valve seat, namely the application of a leveraging force, it is understood that many other forces can be applied to the spraying head 24 that will result in a similar separation. All that is required is that the spraying head 24 receive a force relative to the valve seat 23 that is sufficient to overcome the force of the spring 41 biasing the valve seat 23 into the spraying head 24. Accordingly, the spraying head 24 similarly separates from the valve seat 23 when the fluid pressure is increased enough to overcome the biasing force of the spring. Thus, multiple spraying heads connected to the same fluid source (not shown) can be flushed simultaneously merely by increasing the fluid pressure in the connecting hose.

Figure 10:
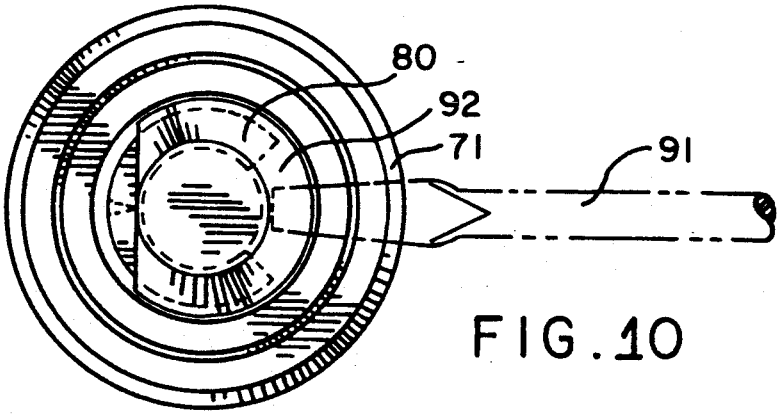
FIG. 10 is an enlarged, elevational view of the spray nozzle taken in the plane of the line 10—10 in FIG. 1.

FIGS. 9 and 10 show a prying tool 91 such as a screwdriver or the like leveraging the mating surface 63 of the spraying head 24 away from the valve seat 23, by pushing off leveraging ridge 71 of the cap 25. By attaching an upper portion 63, or prying lip, to the mating surface 60 of the spraying head 24 via a shaft 65, a shoulder 92 is formed whereby the leveraging tool 91 can wedge under the upper portion 63. Note that as shown in FIG. 3, since the deflection collar 80 forms less than a complete ring, even when the deflection collar is installed as in FIGS. 9 and 10 the spraying head 24 can be manually pried apart from the valve seat 23.

Since the spraying head 24 is secured to the stem 43, the spring 41 is compressed by the flange of the stem 40 whenever the separating force is sufficient to overcome the spring bias. As a result, the spraying head 24 returns to its normal spraying position when the separating force is removed. Because the only way to control the amount of force needed to separate the spraying head 24 from the valve seat 23 for flushing is to replace the spring 4 with one having a different spring constant, undesirable modifications to the flushing sensitivity cannot be made without substantial effort. Thus, an important safety feature of the invention is the ability to carefully regulate the nozzle to prevent unexpected and dangerous flushing operations. This can easily be accomplished by making sure that more than a just slight increase in the line pressure is required to trigger flushing operations, as could occur with incorrectly adjusted nozzles.

Finally, although in the preferred embodiment ridge 71 is present around the periphery of cap 25 to provide a leveraging fulcrum for manually separating the spraying head from the valve seat, the ridge is not necessary to the invention. Even with manual flushing, it is conceivable that the head could be pulled away from the valve seat, for example by using one or more pairs of pliers.

What is claimed is:

1. A self cleaning spray nozzle for spraying a fluid from a pressurized fluid source, the nozzle comprising:

a tubular fitting including a longitudinal interior fluid passage, the fitting having an inlet and an outlet, the inlet having means for connecting to the fluid source;

a tubular stem having an inlet and an outlet for conveying fluid therethrough, the inlet of the stem extending partially into the outlet end of the fitting so that fluid entering the fitting flows into and through the stem in a longitudinal direction, the stem further including a flange;

a valve seat including a skirt, the skirt having an inner surface dimensioned to slidably fit around the stem and an outer surface dimensioned to fit inside the outlet of the tubular fitting for fixing the radial position of the valve seat, the valve seat further including a lip dimensioned to longitudinally position the valve seat at the outlet of the tubular fitting and form a seal between the valve seat and the outlet of the tubular fitting;

means for maintaining the valve seat in positive contact with the fitting to prevent longitudinal and radial displacement of the valve seat;

a spraying head having means for attaching to the tubular stem, the spraying head including outlet means, the spraying head further including a mating surface for mating with the valve seat; and a spring surrounding the stem and biased against the flange of the stem for providing a predetermined fixed biasing force on the valve seat, the spring forcing the valve seat against the mating surface of the spraying head forming a seal between the valve seat and the mating surface of the spraying head to restrict fluid flow at the seal, the outlet means providing a passage for fluid flow so that fluid is dispersed in a predetermined pattern when the seal is formed;

whereby a force applied to the spraying head sufficient to overcome the spring bias separates the spraying head from the valve seat breaking the seal and allowing the fluid to flush the outlet means.

2. The spray nozzle of claim 1 wherein the tubular fitting is a standard Unijet TM fitting.

3. The spray nozzle of claim 1 wherein the means for maintaining the valve seat in positive contact with the fitting is a ring shaped cap, the cap including an inner annular collar dimensioned to slidably fit around the spraying head and hold the lip of the valve seat against the outlet of the fitting, the fitting and cap having complementary screw threads.

4. The spray nozzle of claim 3 wherein the spraying head includes a prying lip rigidly attached to and extending from the mating surface of the spraying head for cooperation with a ridge of the cap that extends axially from the periphery of the cap, such that the prying lip and spraying head can be manually leveraged to separate from the valve seat with the insertion of a screwdriver blade over the ridge and under the prying lip.

5. The spray nozzle of claim 1 wherein the means for connecting the inlet of the tubular fitting to a fluid source is a threaded connection.

6. The spray nozzle of claim 1 wherein the means for connecting the spraying head to the stem is a threaded connection.

7. The spray nozzle of claim 1 wherein the outlet means is a wedge shaped notch present in the mating surface of the spraying head.

8. The spray nozzle of claim 1 wherein the mating surface of the spraying head is essentially disk shaped.

9. The spray nozzle of claim 8 wherein the outlet means is a discontinuity in the disk shape of the spraying head that causes a breach in the seal, wherein the shape of the discontinuity defines the shape of the predetermined pattern.

10. The spray nozzle of claim 1 wherein the seal includes a material sandwiched between the valve seat and the mating surface of the spraying head.

11. The spray nozzle of claim 10 wherein the material is a Teflon TM washer.

12. The spray nozzle of olaim 1 wherein the tubular stem, the valve seat, the spraying head and the spring form a unitary assembly, which is rotatable in the tubular fitting so that the outlet means is aimable.

13. The spray nozzle of claim 1 wherein the inlet of the tubular stem is funnel shaped to facilitate fluid flow into the inlet of the stem.

14. The spray nozzle of claim 1 further comprising a deflection collar disposed adjacent the outlet means, the deflection collar diverting the sprayed fluid in a predetermined manner.

15. The spray nozzle of claim 14 wherein the deflection collar comprises resilient material, the deflection collar being momentarily deformed during engaging and disengaging from the spray nozzle.

16. The spray nozzle of claim 1 wherein the skirt of the valve seat includes a first inner surface dimensioned to slidably fit around the stem and a second inner surface disposed adjacent the outlet of the stem, the second inner surface having a circumference larger than the first inner surface in order to facilitate fluid flow.

* * * * *